US010013957B2

(12) United States Patent
Falbo

(10) Patent No.: US 10,013,957 B2
(45) Date of Patent: Jul. 3, 2018

(54) TENSION REDISTRIBUTING AND BALANCING SYSTEM FOR STRINGED INSTRUMENTS

(71) Applicant: Frank Falbo, Ventura, CA (US)

(72) Inventor: Frank Falbo, Ventura, CA (US)

(73) Assignee: Avi El-Kiss, Los Angeles, CA (US)

( * ) Notice: Subject to any disclaimer, the term of this patent is extended or adjusted under 35 U.S.C. 154(b) by 0 days.

(21) Appl. No.: 14/043,840

(22) Filed: Oct. 1, 2013

(65) Prior Publication Data

US 2015/0243262 A1 Aug. 27, 2015

Related U.S. Application Data

(60) Provisional application No. 61/708,430, filed on Oct. 1, 2012.

(51) Int. Cl.

| | |
|---|---|
| ***G10D 3/10*** | (2006.01) |
| ***G10D 3/12*** | (2006.01) |
| ***G10D 3/04*** | (2006.01) |

(52) U.S. Cl.

CPC ..... *G10D 3/12* (2013.01); *G10D 3/04* (2013.01)

(58) Field of Classification Search

USPC ..... 84/297 R

See application file for complete search history.

(56) References Cited

U.S. PATENT DOCUMENTS

| | | | | | |
|---|---|---|---|---|---|
| 4,411,186 | A * | 10/1983 | Faivre | G10D 3/02 | 84/275 |
| 4,807,508 | A | 2/1989 | Yairi | | |
| 4,840,103 | A * | 6/1989 | Mayer | G10D 3/12 | 84/291 |
| 4,951,543 | A * | 8/1990 | Cipriani | G10D 3/04 | 84/291 |
| 5,227,571 | A * | 7/1993 | Cipriani | G10D 3/04 | 84/298 |
| 5,260,505 | A | 11/1993 | Kendall | | |
| 5,949,006 | A * | 9/1999 | Hechler | G10D 1/00 | 84/267 |
| 6,114,617 | A * | 9/2000 | Scheib | 84/312 R | |
| 7,112,733 | B1 | 9/2006 | Babicz | | |
| 7,351,895 | B1 * | 4/2008 | LeBlanc | 84/298 | |
| 7,566,823 | B1 * | 7/2009 | Niskanen | G10D 3/04 | 84/307 |
| 7,847,170 | B1 * | 12/2010 | Anderson et al. | 84/298 | |
| 8,138,403 | B1 | 3/2012 | Kemp | | |
| 8,569,602 | B2 * | 10/2013 | Nash | G10D 1/08 | 84/267 |
| 2003/0172793 | A1 * | 9/2003 | Hori | G10H 3/185 | 84/298 |
| 2011/0179937 | A1 * | 7/2011 | Miloslavsky | 84/291 | |

* cited by examiner

*Primary Examiner* — Christopher Uhlir
(74) *Attorney, Agent, or Firm* — Lance M. Pritikin

(57) ABSTRACT

A tension redistributing and balancing system for stringed instruments, consisting of bridge and string coupling mechanism which utilizes the very same string tension required to reach the desired pitch to apply inverted torque which counteracts the very same tension and torque forces as they relate to the bridge and/or soundboard.

10 Claims, 1 Drawing Sheet

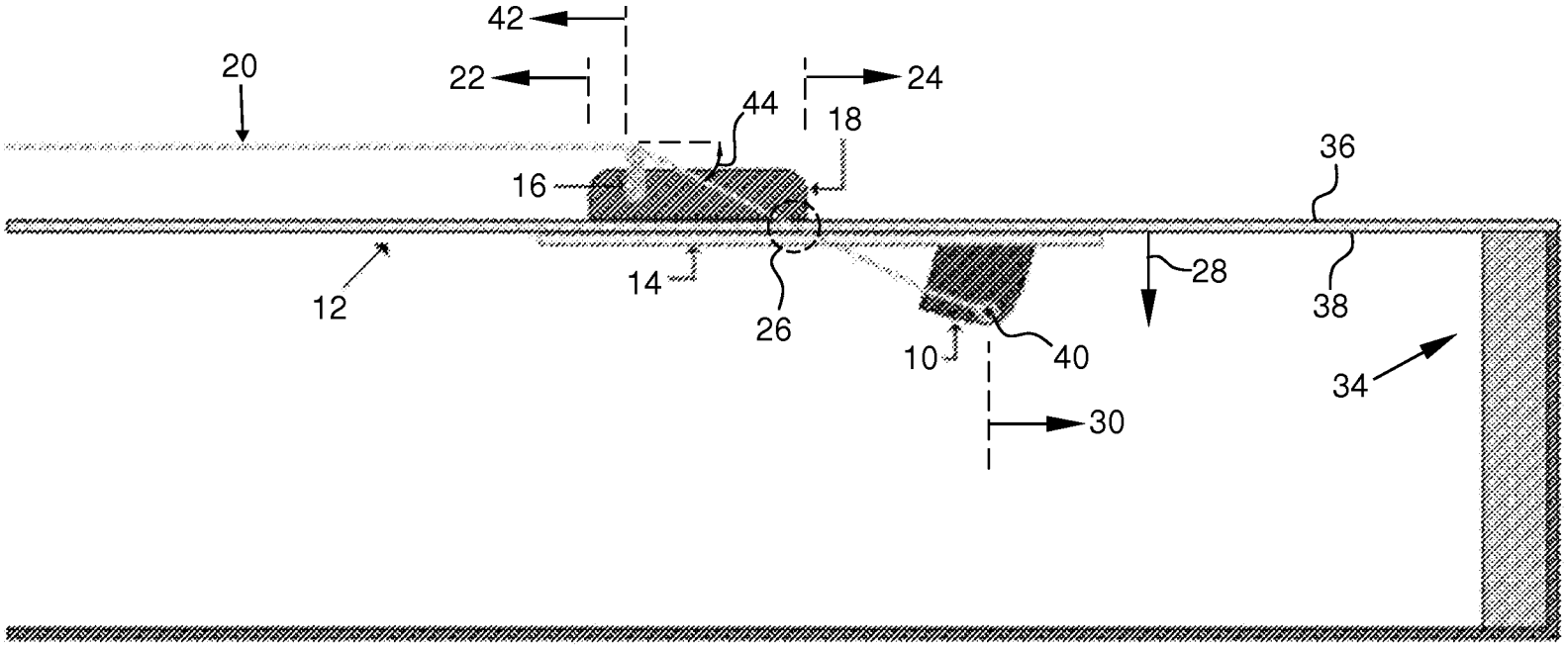
34
36
38
28
30
40
10
24
18
26
44
14
42
22
16
12
20

TENSION REDISTRIBUTING AND BALANCING SYSTEM FOR STRINGED INSTRUMENTS

RELATED APPLICATIONS

This application claims the benefit of U.S. Provisional Application No. 61/708,430 filed Oct. 1, 2012.

BACKGROUND OF THE INVENTION

Stringed instrument designs are known to require adequate structural strength to accommodate the range of tension exerted from the string or groupings of strings required to reach the desired pitch. The instrument design also must be able to accommodate the increased tension of pulling on the strings, or otherwise activating the strings vibration pattern to produce sound. Stringed instrument designs should be able to withstand far greater tension than that required to reach pitch, in the event the strings are struck hard, get caught on something, or are tuned up temporarily to reach a higher pitch than that consistent with the design.

Some stringed instruments such as banjos and all bowed instruments from the smallest of violins to the largest of upright basses bear the string tension by attaching the strings to the back side of the instrument, rather than the top of the instrument. Often referred to as simply the "tailpiece" on bowed instruments or a "trapeze tailpiece" on guitars and basses, this method of string attachment minimizes downward pressure on the top of the instrument, and uses the lateral strength of the instrument's side structure to bear the load. Many stringed instruments such as acoustic guitar & bass utilize a design in which the strings penetrate the top of the instrument (sound board) and attach inside the guitar in a manner converting the tension into rotational pull.

Common understanding dictates that string tension on an acoustic bridge pulls in the direction of the strings. This results in a tendency to for the bridge area to pull in a rotational direction, since the strings are elevated off of the soundboard. This elevation converts the tension into torque, regardless of whether the strings are attached to the soundboard on top of the soundboard, or penetrate the soundboard and attach underneath the soundboard. The area behind the bridge pulls up into an arch, and the area in front of the bridge caves down and in. Substantial bracing is required to maintain an acceptable degree of straightness in the top over time. The bracing is oriented for required structural support and the negative impact of the bracing on vibrations of the top is implied and accepted.

One method U.S. Pat. No. 7,112,733 (Babicz) redirects the attachment point of the string end to a different place on the soundboard which moves the tension to the sides of the guitar where it can no longer drive the soundboard with the same inertia. A second method, U.S. Pat. No. 5,260,505 (Kendall) counteracts the rotational torque by adding pressure and mass in the opposite direction, arresting the vibration of the soundboard, and applying pressure to places that may or may not be designed to accept such pressure. Like Kendall, a third method, U.S. Pat. No. 7,462,767 (Swift) uses similar geometry as Kendall but applies the tension in the other direction to the neck block, rather than the heel block. Both Kendall and Swift anchor the torque redistribution to an area other than the instrument's soundboard, the area in which the device is intended to influence.

This system harnesses all of that tension to be utilized to the greatest degree as envisioned by the instrument designer. The designer is now free to brace soundboards for greater sonic manipulation, rather than compromising sonic properties for structural stability. U.S. Pat. No. 4,807,508 (Yairi) also utilizes all of the string tension on the soundboard, but splits the bridge into two sections. Aside from targeting certain sonic attributes, the benefit to Yairi was to reduce and/or eliminate failure of the glue joints holding the bridge and bridge plates to the soundboard. The string tension supports the glue joints instead of opposing them. This design spreads the torque across a larger area of the underside of the top, while making structural improvements in the way the torque is managed. The traditional relationship of the string anchors (ball ends) to the top, however, do not impart any negative torque into the soundboard, nor do they release torque from the assembly. Those skilled in the art have seen aging instruments with this technology which bulge in the area behind the bridge, from the inherent torque.

Current solutions have a negative impact on the sonic transfer to the soundboard, and therefore the sound and projection of the instrument into the space around it. Prior efforts to impart opposing torque forces through the use of an anchor point not located on the soundboard in the proximity of the bridge, work to reduce the energy transfer to the soundboard.

This invention is an improvement on what current attempts to manage and/or divert these forces. This system allows the full tension of the string to drive vibrations into the soundboard, which results in efficient generation of amplitude across a full frequency spectrum. This affords an optimal relationship between guitar design for tonal properties and structural stability.

This invention can also produce a stringed instrument vibrato unit that is self-equalizing. String tension and changes in pitch alter the zero position of traditional vibrato units, unless they are locked or stabilized by an outside force. The string tension itself can be harnessed so that variations in string tension are torque neutral, and only the intentional movement of the vibrato unit by the vibrato arm or other method would produce the change in pitch associated with vibrato units.

SUMMARY

The present invention relates to a stringed instrument with a bridge and string anchor point which is contained within the boundaries of the top soundboard of the instrument.

Stringed instrument designs are known to require adequate structural strength to accommodate the range of tension exerted from the string or groupings of strings required to reach the desired pitch. The instrument design also must be able to accommodate the increased tension of pulling on the strings, or otherwise activating the strings vibration pattern to produce sound. Stringed instrument designs should be able to withstand far greater tension than that required to reach pitch, in the event the strings are struck with excessive force, get caught on something, or are tuned up temporarily to reach a higher pitch than that consistent with the design intent.

Some stringed instruments such as banjos, and all bowed instruments from the smallest of violins to the largest of upright basses are designed to bear the string tension by attaching the strings' tension to the back side of the instrument, rather than the top of the instrument. Often referred to as simply the "tailpiece" on bowed instruments or sometimes a "trapeze tailpiece" on guitars and basses, this method of string attachment reduces downward pressure and torque on the top of the instrument, and uses the lateral strength of the instrument's side structure to bear the load. Many stringed instruments such as acoustic guitar & bass utilize a design in which the strings penetrate the top of the instrument (sound board) and attach inside the guitar in a manner converting the tension into long dipole forward rotating pull, or torque.

Common understanding dictates that string tension on an acoustic bridge pulls in the direction of the strings. This results in a tendency to for the bridge area to pull in a rotational direction. The area behind the bridge pulls up into an arch, and the area in front of the bridge caves down and in. Substantial bracing is required to maintain an acceptable degree of straightness in the top over time. The bracing is oriented for required structural support and the negative impact of the bracing on vibrations of the top is implied and accepted. The invention claimed here solves this problem.

As with traditional stringed instrument bridges, the string passes over the bridge saddle, using it as a fulcrum to achieve pitch and intonation. Unlike traditional stringed instruments, in which the string passes through the top producing forward rotational torque, or passes over the bridge to an anchor point behind the bridge but still above the surface of the top, this design passes the strings through the top to an anchor point which applies counter-rotational torque to the top. This balances the forward-rotational torque on the top, while still allowing the total force of the string tension to vibrate the soundboard of the instrument, which produces both sonic and structural benefits throughout the aging process and climate changes.

The degree of negative torque is entirely malleable, with changes in the relationship between the angle, height differentials, contact surface area, and location of the contact surfaces. Any degree of torque counteraction and vibration distribution can be attained with the relationship created by this design. This design can be implemented on virtually any stringed instrument design.

BRIEF DESCRIPTION OF THE DRAWINGS

FIG. 1 is a diagrammatic partial section view of a stringed instrument with tension redistributing and balancing system in accordance with one embodiment of the present invention.

DETAILED DESCRIPTION

The string end receiving article 10 accepts the string 20 in such a way as to harness the energy freely, without excess reduction in tension due to binding, other frictions, or excessive fulcrum points. As illustrated for example in FIG. 1, this article then manipulates the forward rotational torque as applied to the soundboard 12 by attaching to the top (e.g., inner face 38 of the soundboard 12) through the bridge plate 14 at a point or points that apply counter-rotational torque behind 24 and/or in front 22 of the bridge 18. Using the bridge saddle 16 as the fulcrum point for pitch, the required tension to reach pitch is maintained behind the bridge 18, to the string end receiving article 10 thus allowing this tension to be redirected inversely to the fullest extent.

The counter-rotational torque is primarily generated by the string end receiving article. The location of the receiving article determines the area(s) in which counter-rotational torque is exerted onto the soundboard. The distribution of this counter-rotational force and sound generating vibrations are manipulated by the thickness and surface area of the bridge plate. The bridge plate can be shaped to manipulate the manner in which this counter-rotation is imparted onto the soundboard, and under the bridge area. A bridge plate is not required for the string end receiving article to function in the manner described. The functionality of the bridge plate can also be integrated into the string end receiving article. The method of string attachment is inconsequential. The bridge size and shape can alter the vibration transfer and therefore sonic properties of the soundboard, but is malleable within reasonable mass units associated with bridge and saddle arrangements for like stringed instruments by those skilled in the art. As with the bridge plate, the size and contact points with the soundboard manipulate the distribution of torque and sound generating vibrations. The dimensional and angular relationships between all contact points will determine the overall rotational impact the string tension exerts onto the soundboard. When targeting partial torque equalization, bracing is considered to offset the remaining rotational torque. When targeting full or nearly full rotational torque equalization, bracing function is limited to maintaining structural stability across other axes of the material used for the soundboard, as well as stability for the overall string pull parallel to the string exerted by the string tension. This design allows for any range of torque neutralization to be targeted.

To optimize the instrument design, the break angle 44 of the string, the location of the bridge plate, and the contact point(s) of the string end receiving article can be manipulated to counteract more or less rotational torque, and/or distribute vibrations across the soundboard differently for sonic variety. Calculations are made to deduce how much counter-rotational torque is required to achieve structural stability in accordance to chosen bracing intensity. Near total equalization of rotational torque (if desired) is possible with precise location and dimensional considerations for the string end receiving article and bridge plate.

There are many embodiments of this invention. Material selection is highly variable, including but not limited to woods, metals, composites, stereo lithography, plastics, and resin impregnated materials. The string end receiving article can be shaped in a number of ways including but not limited to simple geometric shapes or the most complex structures, with the overarching principle that the string end 40 will be held firmly without risk of premature mechanical failure within the part due to normal use, and that the tension from the string will be applied to parts of the soundboard in a manner that produces counter-rotational torque. In order for counter-rotational torque to be produced, the attachment point(s) must be in an area between the point 26 at which the string intersects the soundboard and the end 34 of the instrument behind 30 the string end 40, and/or in front 42 of the saddle 16. The former applies a pull down force on the soundboard; the latter applies a push up force. Thus, as illustrated for example in FIG. 1, the article 10 holds the string end 40 firmly and protrudes outwardly 28 of the inner face 38 so as to be in torque levering communication between the tensioned string 20 and the soundboard 12. Put another way, as shown for example in FIG. 1, the article 10 protrudes outwardly 28 of the inner face 38 to come into torque leveraging contact with the string 20, thereby converting the tension of the string 20 into torque applied to the soundboard 12.

Necessary elements for any stringed instrument include some fulcrum point for pitch creation, exemplified by the saddle in this design. A saddle can be integrated into the bridge, or the soundboard. As illustrated in FIG. 1 for example, the saddle 16 is typically disposed outwardly of the outer face 36 of the soundboard 12, and a bridge 18 may be disposed between the saddle 16 and soundboard 12. The saddle can also be integrated into the string end receiving unit, but limits the vibration transferred to the soundboard, which may or may not produce the sonic result desired by the instrument designer skilled in the art, though it would counteract rotational torque. The soundboard is required to produce an audible tone, but can be omitted and replaced with a solid body instrument design in the event counter-rotational torque is desired for tonal purposes within a solid or semi-solid design intended to be electrified. Those skilled in the art understand that the net effect of string tension transferred to a solid body instrument still has an effect on the electrically amplified sound of the instrument.

The function of the string end receiving article, which is controlling the application of counter-rotational force is necessary to equalize all, nearly all, or some forward rotating torque. The string end receiving article can be integrated into the soundboard or a solid body instrument design.

Balancing forward rotating torque can be accomplished by pulling downward behind the bridge area, or pushing upward in front of the bridge area, or a combination thereof. It is understood by those skilled in the art that traditional string attachment methods such as those used on an acoustic guitar with bridge pins turns the string tension into forward rotating torque distributed to the surrounding areas. In this manner, applying counter-rotational torque, which can be referred to as balancing or equalizing the torque, is understood by those skilled in the art to be any torque applied to the area surrounding the bridge that would have otherwise been subjected to the forward rotational torque.

Utilization of the invention includes but is not limited to manufacturing instruments with the invention integrated, retrofitting instruments with any device functioning on the principles of the string end receiving article, and utilizing a device functioning on the principles of the string end receiving article for one, or some but not all strings on the instrument.

Additionally: The scope of this invention is intended to include any and all stringed instruments in which the string is intended to produce a tone or pitch due to vibration. The principles of the invention can be extended to any entity where controlling vibration induced by any cabling or stringing, and stringed instruments that utilize a vibrato mechanism. The principles of the string end receiving unit can be applied to a vibrato unit to stabilize what is considered the "zero point" understood to be the location of the vibrato unit when at rest, with the instrument tuned to pitch.

This invention can produce a stringed instrument vibrato unit that is self-equalizing. String tension and changes in pitch alter the zero position of traditional vibrato units, unless they are locked or stabilized by an outside force. The string tension itself can be harnessed so that variations in string tension are rotational torque neutral, and only the intentional movement of the vibrato unit by the vibrato arm or other method would produce the change in pitch associated with vibrato units.

In embodiments of a system of bridge and string coupling mechanism, the stringed instrument strings may be harnessed to a soundboard. In such embodiments, any percentage of torque neutralization may be inflicted onto the soundboard solely by leveraging the string's own tension. Depending upon the embodiment, any percentage of torque neutralization may be inflicted onto the soundboard absent the application of an additional fixed vector force, such as with rod(s) or plates. Depending upon the embodiment, any percentage of torque neutralization may be inflicted onto the soundboard absent the application of an additional variable vector force, such as with spring(s) or strings.

Embodiments may be fashioned out of any suitable material, organic or manufactured with, for example, a Shore A durometer rating greater than 40. In particular embodiments, the torque neutralization may be utilized to balance torque from string tension, while allowing deliberate bridge and/or string coupling mechanism movement to fluctuate pitch, in the manner currently recognized by those skilled in the art as the function of a vibrato bridge system.

What is claimed is:

1. A stringed musical instrument with tension redistributing and balancing system, the string musical instrument comprising:

a soundboard having an outer face and an inner face;

a saddle disposed outwardly of the outer face;

a string end receiving article wholly positioned behind the saddle; and a string being in tension and having a string end, the string breaking against the saddle, extending to the article and intersecting the soundboard therebetween;

wherein the article holds the string end firmly and protrudes outwardly of the inner face so as to be in torque levering communication between the tensioned string and the soundboard, the article thereby applying a torque to the soundboard at the position of the string end receiving article;

wherein no tuning keys are mounted to the soundboard behind the saddle; and wherein the string end receiving article is attached to the inner face by way of a bridge plate.

2. A stringed musical instrument as defined in claim 1, further comprising a bridge disposed between the saddle and the soundboard.

3. A stringed musical instrument as defined in claim 1, wherein the string end receiving article is attached to the inner face between a body end of the instrument and where the string intersects the soundboard.

4. A stringed musical instrument as defined in claim 2 wherein the string end receiving article and bridge are fashioned out of a material with a Shore A durometer rating greater than 40.

5. A stringed musical instrument as defined in claim 1, wherein the string end receiving article does not extend through the soundboard.

6. A stringed musical instrument as defined in claim 1, wherein an opening is disposed in the soundboard between the saddle and the string end receiving article.

7. A stringed musical instrument with tension redistributing and balancing system, the string musical instrument comprising:

a soundboard having an outer face and an inner face;

a saddle disposed outwardly of the outer face;

a string end receiving article wholly positioned behind the saddle and forming no part of a tuning key; and a string being in tension and having a string end, the string breaking against the saddle, extending to the article and intersecting the soundboard therebetween;

wherein the article holds the string end firmly and protrudes outwardly of the inner face so as to be in torque levering communication between the tensioned string and the soundboard, the article thereby applying a torque to the soundboard at the position of the string end receiving article; and wherein the string end receiving article is attached to the inner face by way of a bridge plate.

8. A stringed musical instrument as defined in claim 7, wherein the string end receiving article does not extend through the soundboard.

9. A stringed musical instrument as defined in claim 7, wherein an opening is disposed in the soundboard between the saddle and the string end receiving article which is only large enough to receive a respective string therethrough.

10. A stringed musical instrument as defined in claim 7, wherein no tuning keys are mounted to the soundboard behind the saddle.

* * * * *